US008216509B2

(12) United States Patent
Strangman

(10) Patent No.: US 8,216,509 B2
(45) Date of Patent: Jul. 10, 2012

(54) NICKEL-BASE SUPERALLOYS

(75) Inventor: Tom Strangman, Prescott, AZ (US)

(73) Assignee: Honeywell International Inc., Morristown, NJ (US)

( * ) Notice: Subject to any disclaimer, the term of this patent is extended or adjusted under 35 U.S.C. 154(b) by 635 days.

(21) Appl. No.: 12/366,431

(22) Filed: Feb. 5, 2009

(65) Prior Publication Data

US 2010/0196191 A1 Aug. 5, 2010

(51) Int. Cl.
*C22C 19/05* (2006.01)

(52) U.S. Cl. ..... 420/448

(58) Field of Classification Search ..... 148/677; 420/448

See application file for complete search history.

(56) References Cited

U.S. PATENT DOCUMENTS

| | | | | |
|---|---|---|---|---|
| 3,887,363 | A | 6/1975 | Smashey et al. | |
| 4,116,723 | A | 9/1978 | Gell et al. | |
| 4,169,742 | A | 10/1979 | Wukusick et al. | |
| 4,222,794 | A | 9/1980 | Schweizer et al. | |
| 4,253,885 | A * | 3/1981 | Maurer et al. | 148/527 |
| 4,325,756 | A | 4/1982 | Brown et al. | |
| 4,328,045 | A * | 5/1982 | Pearson et al. | 148/555 |
| 4,371,404 | A | 2/1983 | Duhl et al. | |
| 4,388,124 | A | 6/1983 | Henry | |
| 4,643,782 | A | 2/1987 | Harris et al. | |
| 4,677,035 | A | 6/1987 | Fiedler et al. | |
| 4,707,192 | A | 11/1987 | Yamazaki et al. | |
| 4,717,435 | A | 1/1988 | Kawasaki et al. | |
| 4,719,080 | A | 1/1988 | Duhl et al. | |
| 4,764,225 | A | 8/1988 | Shankar et al. | |
| 4,765,850 | A | 8/1988 | Schweizer | |
| 4,801,513 | A | 1/1989 | Duhl et al. | |
| 4,837,384 | A | 6/1989 | Khan et al. | |
| 4,849,030 | A | 7/1989 | Darolia et al. | |
| 4,885,216 | A | 12/1989 | Naik | |
| 4,888,069 | A | 12/1989 | Duhl et al. | |
| 4,900,511 | A | 2/1990 | Khan et al. | |
| 4,908,183 | A | 3/1990 | Chin et al. | |
| 4,935,072 | A | 6/1990 | Nguyen-Dinh | |
| 4,976,791 | A | 12/1990 | Ohno et al. | |
| 5,047,091 | A | 9/1991 | Khan et al. | |
| 5,069,873 | A | 12/1991 | Harris et al. | |
| 5,077,004 | A | 12/1991 | Schweizer et al. | |
| 5,077,141 | A | 12/1991 | Naik et al. | |
| 5,151,249 | A | 9/1992 | Austin et al. | |
| 5,154,884 | A | 10/1992 | Wukusick et al. | |
| 5,173,255 | A * | 12/1992 | Ross et al. | 420/445 |
| 5,270,123 | A | 12/1993 | Walston et al. | |
| 5,366,695 | A | 11/1994 | Erickson | |
| 5,395,584 | A | 3/1995 | Berger et al. | |
| 5,403,547 | A | 4/1995 | Smith et al. | |
| 5,455,120 | A | 10/1995 | Walston et al. | |
| 5,482,789 | A | 1/1996 | O'Hara et al. | |
| 5,540,789 | A | 7/1996 | Bornstein et al. | |
| 5,540,790 | A | 7/1996 | Erickson | |
| 5,549,765 | A | 8/1996 | Mihalisin et al. | |
| 5,551,212 | A | 9/1996 | Odenthal | |
| 5,660,649 | A | 8/1997 | Bornstein et al. | |
| 5,759,303 | A | 6/1998 | Mihalisin et al. | |
| 5,888,451 | A | 3/1999 | Konter et al. | |
| 5,916,382 | A | 6/1999 | Sato et al. | |
| 5,916,384 | A | 6/1999 | Das | |
| 5,925,198 | A | 7/1999 | Das | |
| 6,007,645 | A | 12/1999 | Cetel et al. | |
| 6,051,083 | A | 4/2000 | Tamaki et al. | |
| 6,054,096 | A | 4/2000 | Duhl et al. | |
| 6,074,602 | A | 6/2000 | Wukusick et al. | |
| 6,096,141 | A | 8/2000 | King et al. | |
| 6,159,314 | A | 12/2000 | Koizumi et al. | |
| 6,224,695 | B1 | 5/2001 | Kobayashi et al. | |
| 6,375,766 | B1 | 4/2002 | Czech | |
| 6,410,153 | B1 | 6/2002 | Broomfield et al. | |
| 6,444,057 | B1 | 9/2002 | Darolia et al. | |
| 6,632,299 | B1 | 10/2003 | Harris | |
| 6,673,308 | B2 | 1/2004 | Hino et al. | |
| 6,706,241 | B1 | 3/2004 | Baumann et al. | |
| 6,730,264 | B2 | 5/2004 | Cao | |
| 6,755,921 | B2 | 6/2004 | Kobayashi et al. | |
| 6,818,077 | B2 | 11/2004 | Yoshinari et al. | |
| 6,866,727 | B1 | 3/2005 | Hieber et al. | |

(Continued)

FOREIGN PATENT DOCUMENTS

EP 1031637 A1 8/2000

(Continued)

OTHER PUBLICATIONS

ASM International, Materials Park, Ohio, ASM Specialty Handbook: Nickel, Cobalt, and Their Alloys, "Metallography and Microstructures of Heat Resistant Alloys", Dec. 2000, pp. 302-304.*

(Continued)

*Primary Examiner* — Jessee R. Roe

(74) *Attorney, Agent, or Firm* — Ingrassia Fisher & Lorenz, P.C.

(57) ABSTRACT

Nickel-base superalloys are provided. In an embodiment, a nickel-base superalloy includes a concentration of large radius elements disposed in the gamma phase of the nickel-base superalloy in a range of from about 3.6 to about 6.7, by atomic percent and a concentration of large radius elements disposed in the gamma prime phase of the nickel-base superalloy in a range of from about 4.2 to about 7.0, by atomic percent. The nickel-base superalloy has a density of about 9.0 grams per centimeter$^3$ or less.

12 Claims, No Drawings

U.S. PATENT DOCUMENTS

| | | | |
|---|---|---|---|
| 6,905,559 | B2 | 6/2005 | O'Hara et al. |
| 6,908,518 | B2 | 6/2005 | Bouse et al. |
| 6,936,116 | B2 | 8/2005 | Glatzel et al. |
| 6,966,956 | B2 | 11/2005 | Koizumi et al. |
| 7,011,721 | B2 | 3/2006 | Harris et al. |
| 7,115,175 | B2 | 10/2006 | DeLuca et al. |
| 7,169,241 | B2 | 1/2007 | Tamaki et al. |
| 7,261,783 | B1 | 8/2007 | MacKay et al. |
| 7,306,682 | B2 | 12/2007 | Yoshinari et al. |
| 2002/0062886 | A1 | 5/2002 | Hino et al. |
| 2002/0157738 | A1 | 10/2002 | Burgel et al. |
| 2003/0041930 | A1 | 3/2003 | DeLuca et al. |
| 2003/0152799 | A1 | 8/2003 | Grossman et al. |
| 2004/0011443 | A1 | 1/2004 | Bouse et al. |
| 2004/0042927 | A1 | 3/2004 | O'Hara et al. |
| 2004/0234410 | A1 | 11/2004 | Shipton et al. |
| 2005/0000603 | A1 | 1/2005 | Corrigan et al. |
| 2005/0092398 | A1 | 5/2005 | Kobayashi et al. |
| 2005/0224144 | A1 | 10/2005 | Pollock et al. |
| 2006/0011271 | A1 | 1/2006 | Kobayashi et al. |
| 2006/0039820 | A1 | 2/2006 | Darolia et al. |
| 2006/0057018 | A1 | 3/2006 | Hobbs et al. |
| 2006/0093851 | A1 | 5/2006 | Darolia et al. |
| 2006/0207693 | A1 | 9/2006 | DeLuca et al. |
| 2007/0044869 | A1 | 3/2007 | Darolia et al. |
| 2007/0059550 | A1 | 3/2007 | Jones et al. |
| 2008/0170961 | A1 | 7/2008 | Seetharaman et al. |

FOREIGN PATENT DOCUMENTS

| | | | |
|---|---|---|---|
| EP | 1394278 | A1 | 3/2004 |
| EP | 1642989 | A2 | 4/2006 |
| EP | 1760164 | A1 | 3/2007 |
| EP | 1927669 | A1 | 6/2008 |
| JP | 2000239771 | A | 9/2000 |

OTHER PUBLICATIONS

ASM International, Materials Park, Ohio, Properties and Selection: Nonferrous Alloys and Special Purpose Materials: "Rare Earth Metals", Oct. 1990, vol. 2, pp. 720-732.*

Walston, S. et al.; Joint Development of a Fourth Generation Single Crystal Superalloy; Superalloys 2004, TMS (The Minerals, Metals & Materials Society) 2004.

EP extended European search report, EP 10151841.3-1215/2216420 dated Nov. 5, 2012.

US 4,923,525, 05/1990, Khan et al. (withdrawn)

* cited by examiner

NICKEL-BASE SUPERALLOYS

TECHNICAL FIELD

The inventive subject matter generally relates to turbine engine components, and more particularly relates to nickel-base superalloys for use with turbine engine components.

BACKGROUND

Gas turbine engines may be used to power various types of vehicles and systems, such as air or land-based vehicles. In typical gas turbine engines, compressed air generated by axial and/or radial compressors is mixed with fuel and burned, and the expanding hot combustion gases are directed along a flowpath toward a turbine. The turbine includes a turbine nozzle having stationary turbine vanes, and the gas flow deflects off of the vanes and impinges upon turbine blades of a turbine rotor. A rotatable turbine disk or wheel, from which the turbine blades extend, spins at high speeds to produce power. Gas turbine engines used in aircraft use the power to draw more air into the engine and to pass high velocity combustion gas out of the gas turbine aft end to produce a forward thrust. Other gas turbine engines may use the power to turn a propeller or an electrical generator.

Gas turbine engines typically operate more efficiently with increasingly hotter air temperature. The materials used to fabricate the components of the turbine, such as the nozzle guide vanes and turbine blades, typically limit the maximum air temperature. In current gas turbine engines, the turbine blades are made of advanced single crystal nickel-base superalloys such as, for example, CMSX4, SC180, Rene N6, and PWA1484, etc. These materials exhibit good high-temperature strength; however, the high temperature environment within a turbine can cause, among other things, creep, oxidation, and/or thermal fatigue of the turbine blades and nozzles made of these materials. Coatings are commonly employed to significantly improve the resistance of the single-crystal alloys to oxidation and hot corrosion.

For turbine blade applications it is desirable to have single crystal nickel-base superalloys having high-temperature creep strength (normalized by density) that is superior to already-known single crystal nickel-base superalloys. Lower density single crystal superalloy turbine blades reduce the stress on the turbine disk and/or enable the turbine to operate at higher speeds. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Nickel-base superalloys are provided.

According to an embodiment, by way of example only, a nickel-base superalloy has a gamma phase and a gamma prime phase and comprises nickel, small radius elements selected from the group consisting of cobalt, aluminum and chromium, and large radius elements selected from the group consisting of molybdenum, tungsten, rhenium, tantalum, hafnium, titanium, niobium, and precious metal elements, the precious metal elements selected from the group consisting of ruthenium, platinum, iridium and rhodium. A concentration of the large radius elements is disposed in the gamma phase of the nickel-base superalloy being in a range of from about 4.4 to about 6.7, by atomic percent, a concentration of the large radius elements is disposed in the gamma prime phase of the nickel-base superalloy being in a range of from about 4.2 to about 7.0, by atomic percent. About 66% of a total amount of molybdenum is partitioned into the gamma phase of the nickel-base superalloy and about 34% of the total amount of molybdenum is partitioned into the gamma prime phase of the nickel-base superalloy; about 37% of a total amount of tungsten is partitioned into the gamma phase of the nickel-base superalloy and about 63% of the total amount of tungsten is partitioned into the gamma prime phase of the nickel-base superalloy; about 84% of a total amount of rhenium is partitioned into the gamma phase of the nickel-base superalloy and about 16% of the total amount of rhenium is partitioned into the gamma prime phase of the nickel-base superalloy; about 10% of a total amount of tantalum, hafnium, titanium, and niobium is partitioned into the gamma phase of the nickel-base superalloy and about 90% of the total amount of tantalum, hafnium, titanium, and niobium is partitioned into the gamma prime phase of the nickel-base superalloy; and about 46% of a total amount of the precious metal elements is partitioned into the gamma phase of the nickel-base superalloy and about 54% of the total amount of the precious metal elements is partitioned into the gamma prime phase of the nickel-base superalloy. The nickel-base superalloy has a density of about 9.0 grams per centimeter$^3$ or less.

In another embodiment, by way of example only, the nickel-base superalloy includes nickel, small radius elements selected from the group consisting of cobalt, aluminum and chromium, and large radius elements selected from the group molybdenum, tungsten, rhenium, tantalum, hafnium, titanium, niobium, and precious metal elements selected from the group consisting of ruthenium, platinum, iridium and rhodium. A concentration of the large radius elements is disposed in the gamma phase of the nickel-base superalloy being in a range of from about 3.6 to about 4.4, by atomic percent, and a concentration of the large radius elements is disposed in the gamma prime phase of the nickel-base superalloy being in a range of from about 4.2 to about 7.0, by atomic percent. About 66% of a total amount of molybdenum is partitioned into the gamma phase of the nickel-base superalloy and about 34% of the total amount of molybdenum is partitioned into the gamma prime phase of the nickel-base superalloy; about 37% of a total amount of tungsten is partitioned into the gamma phase of the nickel-base superalloy and about 63% of the total amount of tungsten is partitioned into the gamma prime phase of the nickel-base superalloy; about 84% of a total amount of rhenium is partitioned into the gamma phase of the nickel-base superalloy and about 16% of the total amount of rhenium is partitioned into the gamma prime phase of the nickel-base superalloy; about 10% of a total amount of tantalum, hafnium, titanium, and niobium is partitioned into the gamma phase of the nickel-base superalloy and about 90% of the total amount of tantalum, hafnium, titanium, and niobium is partitioned into the gamma prime phase of the nickel-base superalloy; about 46% of a total amount of the precious metal elements is partitioned into the gamma phase of the nickel-base superalloy and about 54% of the total amount of the precious metal elements is partitioned into the gamma prime phase of the nickel-base superalloy. The nickel-base superalloy has a density of about 8.9 grams per centimeter$^3$ or less.

DETAILED DESCRIPTION

The following detailed description is merely exemplary in nature and is not intended to limit the inventive subject matter or the application and uses of the inventive subject matter.

Furthermore, there is no intention to be bound by any theory presented in the preceding background or the following detailed description.

The inventive subject matter provides a single crystal nickel-base superalloy for use in the manufacture of high pressure turbine (HPT) components such as turbine blades and vanes to improve resistance to creep, thermal-mechanical fatigue, and other hazards. The single crystal nickel-base superalloy can be used to improve the ability of components such as turbine blades and vanes to operate at high stresses in higher temperature combustion gas environments than already-known single crystal nickel-base superalloys or to allow less cooling air to be used for reducing temperatures of the HPT components.

In accordance with an embodiment, the nickel-base superalloy includes large radius elements and small radius elements. Generally, the term "large radius element", as used herein, may be defined as an element having an atomic radius that is at least about $1.8\times10^{-10}$ meter, and an element having an atomic radius that is smaller than the aforementioned value may be identified a "small radius element" In an embodiment, the single crystal nickel-base superalloy is broadly defined as comprising nickel and alloying elements selected from the group of cobalt, aluminum, chromium, molybdenum, tungsten, rhenium, tantalum, hafnium, titanium, and niobium and may include precious metal elements, such as ruthenium, iridium, platinum, and/or rhodium. The large radius elements may include molybdenum, tungsten, rhenium, tantalum, hafnium, titanium, niobium, ruthenium, iridium, platinum, and rhodium, and the smaller radius elements may include elements such as nickel, cobalt, chromium, and aluminum.

According to an embodiment, the nickel-base superalloy is comprised of two phases, namely, a nickel solid solution (gamma) matrix phase and ordered intermetallic $Ni_3Al$ solid solution (gamma prime) precipitate phase. Large and small radius atoms in the alloy are partitioned into these gamma matrix and gamma prime precipitate phases. The concentrations of alloying elements comprising the gamma matrix may be referred to as atoms that partition into the gamma phase. The atoms comprising the intermetallic gamma prime precipitates may be referred to as atoms that partition into the gamma prime phase.

Single crystal superalloy turbine components are typically produced by already known investment casting processes. The gamma prime phase precipitated during cooling of a casting is typically not optimum for obtaining maximum creep strength. To improve the strength of a gamma prime precipitate-strengthened single crystal alloy, the alloy is typically solution heat treated just below the liquidus temperature for a few hours to cause substantially all of the gamma prime phase to dissolve into the gamma matrix. Gamma prime particles may subsequently precipitate within the gamma matrix during cooling from the solution heat treatment temperature. High-temperature creep-strength of the single crystal superalloy may be maximized by precipitating the gamma prime particles as an array of cuboidal particles that are approximately 0.45 microns on each side. A small amount of additional very fine gamma prime particles, with particle sizes near about 0.01 micron, may be precipitated out of the gamma matrix during intermediate temperature heat treatments, which further enhances creep and fatigue strength at lower temperature locations in the component, such as at a blade's firtree attachment to a turbine disk. The very fine gamma prime particles solution at high temperatures and do not contribute significantly to high-temperature creep strength.

Precipitated particles of the gamma prime phase have substantially the same crystallographic lattice orientation as the gamma matrix phase. Because the crystallographic lattices of the gamma prime and gamma phases are typically not identical, coherency strains occur, which are accommodated by forming a network of lattice misfit dislocations in the gamma phase at gamma-gamma prime interfaces. The lattice misfit is dependent upon alloy composition. Increasing a lattice mismatch between the gamma prime and gamma phases increases the density of misfit dislocations in the interfacial network that are necessary to accommodate the lattice mismatch. Large radius elements present in the gamma matrix may segregate into these interface dislocations. A single crystal alloy's creep strength may be increased by increasing the density of misfit dislocations and the concentration of large elements in the gamma phase. High-temperature creep deformation may be inhibited by capture of mobile glide dislocations that enter the interfacial network of misfit dislocations. Glide dislocation capture is enabled by short range diffusion of the large radius elements from the misfit dislocation network into the glide dislocation. Once a glide dislocation becomes alloyed with large radius elements, its ability to glide is inhibited.

To achieve improved stress-rupture life, relative to conventional single crystal superalloys, it has been discovered that it may be preferable for a single crystal nickel-base superalloy to have a concentration of large radius elements disposed in the gamma phase of the nickel-base superalloy that is in a range of from about 3.6 to about 6.7, by atomic percent, in an embodiment. In one embodiment, the concentration of large radius elements disposed in the gamma phase of the nickel-base superalloy is in a range of from about 3.6 to about 4.4, by atomic percent. In another embodiment in which the concentration of large radius elements within the gamma phase is in the range of about 3.6 to about 4.4, by atomic percent, it has also been found that a single crystal alloy density of the nickel-base superalloy may be minimized to 8.9 grams per cubic centimeter or lower. In still another embodiment, the concentration of large radius elements disposed in the gamma phase of the nickel-base superalloy is in a range of from about 4.4 to about 6.7, by atomic percent. In such an embodiment, it has also been found that a single crystal alloy density of the nickel-base superalloy may be minimized to 9.0 grams per cubic centimeter or lower. In still another embodiment, the concentration of large radius elements disposed in the gamma prime phase of the nickel-base superalloy is in a range of from about 4.2 to about 7.0, by atomic percent.

As mentioned above, the nickel-base superalloy comprises nickel. Nickel is the majority element in both the gamma phase and the gamma prime phase. In an embodiment, nickel is the most abundant constituent present in the nickel-base superalloy. In a preferred embodiment, nickel may be present in the nickel-base superalloy at a concentration in a range of from about 60.0 to about 70.0, by atomic percent. In still other embodiments, more or less nickel may be included in the superalloy.

In accordance with an embodiment, the nickel-base superalloy further may include molybdenum. Molybdenum is a relatively low-density large radius element that is employed as a solid solution strengthener for the gamma and gamma prime phases and may be present in the nickel-base superalloy at a concentration in a range of from about 3.0 to about 10.0, by atomic percent. In still other embodiments, more or less molybdenum may be included in the superalloy.

The nickel-base superalloy further may include tungsten, in an embodiment. Tungsten may be employed as a solid solution strengthener for the gamma and gamma prime phases. However, due to its relatively high density, its presence may be minimized in the nickel-base superalloy at a concentration in a range of from about 0 to about 0.5, by atomic percent. Thus, in an embodiment, tungsten may not be present in an embodiment of the nickel-base superalloy. In still other embodiments, more tungsten may be included in the superalloy when the concentration of one or more other high density alloying elements is reduced to achieve the single crystal alloy density requirement.

According to an embodiment, rhenium may be included in the nickel-base superalloy. Rhenium is a refractory element that primarily improves strength of the gamma phase of the single crystal superalloy. In an embodiment, rhenium may be present in the nickel-base single-crystal superalloy at a concentration in a range of from about 0.8 to about 2.4, by atomic percent. In other embodiments, more or less rhenium may be included in the superalloy.

In accordance with another embodiment, the nickel-base single-crystal superalloy may comprise one or more precious metal elements that are also large radius elements. In an embodiment, the precious metal elements may be selected from the group of ruthenium, iridium, platinum, and/or rhodium. In addition to improving creep-strength, ruthenium, iridium, platinum, and rhodium may be effective in improving stability of the gamma and gamma prime phases by inhibiting growth of unwanted topologically close-packed (TCP) phases and nucleation and growth of secondary reaction zones. These precious metal elements may also improve the oxidation-resistance properties of the nickel-base single-crystal superalloy. In an embodiment, one or more of these precious metal elements is present at concentrations of up to about 3.0 atomic percent. However, because precious metal elements may be relatively expensive, in another embodiment the concentration of precious metal elements is minimized to zero or trace values. As used herein, the term "trace values" may be defined as 0.01 atomic percent or less.

According to an embodiment, ruthenium is the only precious metal element included in the nickel-base single-crystal superalloy and is present in the nickel-base superalloy at a concentration in a range of from about 0 to about 3.0, by atomic percent. In still other embodiments, more ruthenium may be included in the superalloy.

In another embodiment, the nickel-base superalloy may include tantalum. Tantalum may increase the thermal stability and shear resistance of the gamma prime phase and, consequently, may enhance high-temperature strength. In an embodiment, tantalum may be present in the nickel-base superalloy at a concentration in a range of from about 1.0 to about 4.0, by atomic percent. In other embodiments, more or less tantalum may be included in the superalloy.

Hafnium may be included in the nickel-base superalloy, according to an embodiment. Hafnium may be employed to improve oxidation-resistance of the nickel-base superalloy and to strengthen low-angle grain boundaries that may be acceptable features within the single crystal superalloy to thereby prevent intergranular cracking for providing improved high-temperature strength and ductility. In an embodiment, hafnium may be present in the nickel-base superalloy at a concentration in a range of from about 0 to about 0.4, by atomic percent. In a more preferred embodiment, hafnium may be present in the nickel-base superalloy at a concentration range of about 0.02 to about 0.1, by atomic percent. In still other embodiments, more or less hafnium may be included in the superalloy.

In an embodiment, titanium may be included in the nickel-base superalloy. Titanium is a low-density, large-radius element that primarily partitions to the gamma prime phase. Thus, titanium may be used to replace other relatively heavier elements, in some embodiments of the nickel-base superalloy. For example, in embodiments of the nickel-base superalloy in which tantalum is included, titanium may be incorporated into the nickel-base superalloy to replace a portion of the tantalum in order to decrease the density of the nickel-base superalloy, as titanium is a relatively lighter in weight than tantalum. In an embodiment, titanium may be present in the nickel-base superalloy at a concentration in a range of from about 0.05 to about 5.0, by atomic percent. In a more preferred embodiment, titanium may be present in the nickel-base superalloy at a concentration range of about 0.05 to about 3.0, by atomic percent. In still other embodiments, more or less titanium may be included in the superalloy.

Niobium may be included in the single crystal nickel-base superalloy, according to an embodiment. When included in the nickel-base superalloy, niobium may strengthen the gamma prime phase. In instances in which tantalum is included in the single crystal nickel-base superalloy for providing a particular property, but a relatively lightweight nickel-base superalloy is desired, niobium may be included in the nickel-base superalloy. Specifically, niobium is a relatively lightweight element, as compared to tantalum and may provide similar properties to the nickel-base superalloy when incorporated therein. In an embodiment, niobium may be present in the nickel-base superalloy at a concentration in a range of from about 0 to about 3.0, by atomic percent. Thus, in an embodiment, niobium may not be present in an embodiment of the nickel-base superalloy. In another embodiment, a trace amount of niobium may be present in the nickel-base superalloy. In still other embodiments, more niobium may be included in the superalloy.

As noted above, in some embodiments, additional elements that are smaller radius elements may be included in the single crystal nickel-base superalloy. For example, in an embodiment, the nickel-base superalloy may further include cobalt to improve the alloy's resistance to formation of topological close-packed (TCP) phases. In an embodiment, cobalt may be present in the nickel-base superalloy at a concentration in a range of from about 5.0 to about 15.0, by atomic percent. In a more preferred embodiment, cobalt may be present in the nickel-base superalloy at a concentration of about 10.0, by atomic percent. In still other embodiments, more or less cobalt may be included in the superalloy.

In another example, the single crystal nickel-base superalloy may also include chromium, which may improve the resistance of the superalloy to hot corrosion and oxidation. In an embodiment, chromium may be present in the nickel-base superalloy at a concentration in a range of from about 0 to about 6.0, by atomic percent. Thus, in an embodiment, chromium may not be present in an embodiment of the nickel-base superalloy. In a more preferred embodiments, chromium may be present in the nickel-base superalloy at a concentration in a range of from about 0.5 to about 6.0, by atomic percent, or in a range of from about 1.0 to about 2.0, by atomic percent. In still other embodiments, more or less chromium may be included in the superalloy.

In still another example, aluminum may be included in the single crystal nickel-base superalloy. Aluminum is a primary constituent of the gamma prime phase and improves oxidation-resistance and high-temperature strength properties of the superalloy. In an embodiment, aluminum may be present in the nickel-base single-crystal superalloy at a concentration in a range of from about 10.0 to about 14.0, by atomic percent. In other embodiments, more or less aluminum may be included in the superalloy.

In still another example, the single crystal nickel-base superalloy may also include silicon, which may enhance oxidation resistance and microstructural stability. In an embodiment, silicon may be present in the single crystal nickel-base superalloy at a concentration in a range of from about 0 to about 0.25, by atomic percent. Thus, in an embodiment, silicon may not be present in an embodiment of the nickel-base superalloy. In other embodiments, more silicon may be included in the superalloy.

In yet another example, boron may be included in the nickel-base superalloy. Boron may be included to enhance strength of low-angle grain boundaries present as acceptable imperfections in the single crystal superalloy. In an embodiment, boron may be present in the nickel-base superalloy at a concentration in a range of from about 0 to about 0.05, by atomic percent. Thus, in an embodiment, boron may not be present in an embodiment of the nickel-base superalloy. In another embodiment, more boron may be included in the superalloy.

In yet another example, carbon may also be included to enhance the strength of low-angle grain boundaries that may be present as acceptable imperfections in the single-crystal superalloy. Carbon also precipitates as carbides, which may improve the resistance to high temperature formation of recrystallized grains during solution heat treatment of the single crystal nickel-base superalloy. A carbon addition may also improve the microstructural stability of the alloy by inhibiting nucleation and growth of unwanted TCP phases. In an embodiment, carbon may be present in the nickel-base superalloy at a concentration in a range of from about 0 to about 0.25, by atomic percent. Thus, in an embodiment, carbon may not be present in an embodiment of the nickel-base superalloy. In still another embodiment, more carbon may be included in the superalloy.

In still another example, scandium, yttrium, and/or an element from the lanthanide series may be included in the single crystal nickel-base superalloy to further improve oxidation resistance. According to an embodiment, one or more of scandium, yttrium and/or an element from the lanthanide series may be included in the single crystal nickel-base superalloy. In an embodiment, one or more of scandium, yttrium and/or an element from the lanthanide series may be present in the nickel-base superalloy at a concentration in a range of from about 0 to about 0.1, by atomic percent. Thus, in an embodiment, scandium, yttrium, and/or an element from the lanthanide series may not be present in an embodiment of the nickel-base superalloy. In still other embodiments, more scandium, yttrium and/or an element from the lanthanide series may be included in the superalloy.

As noted above, upon cooling from the solution heat treatment temperature, gamma prime particles nucleate and grow in the gamma matrix, and elements in the single crystal superalloys partition to the gamma and gamma prime phases. Single crystal alloy creep strength is strongly dependent upon how the large radius elements are partitioned into the gamma and the gamma prime phases. About 66% of a total amount of the molybdenum in the alloy is partitioned into the gamma phase of the nickel-base superalloy and about 34% of the total amount of molybdenum is partitioned into the gamma prime phase of the nickel-base superalloy, in an embodiment. About 37% of a total amount of tungsten is partitioned into the gamma phase of the nickel-base superalloy and about 63% of the total amount of tungsten is partitioned into the gamma prime phase of the nickel-base superalloy, in an embodiment. About 84% of a total amount of rhenium is partitioned into the gamma phase of the nickel-base superalloy and about 16% of the total amount of rhenium is partitioned into the gamma prime phase of the nickel-base superalloy, in an embodiment. In embodiments in which precious metal elements are included, about 46% of a total amount of the precious metal elements is partitioned into the gamma phase of the nickel-base superalloy and about 54% of the total amount of the precious metal elements is partitioned into the gamma prime phase of the nickel-base superalloy. About 10% of a total amount of tantalum, hafnium, titanium, and niobium is partitioned into the gamma phase of the nickel-base superalloy and about 90% of the total amount of tantalum, hafnium, titanium, and niobium is partitioned into the gamma prime phase of the nickel-base superalloy, in an embodiment.

When chromium is present within the single crystal nickel-base superalloy, about 78% of a total amount of chromium is partitioned into the gamma phase of the nickel-base superalloy and about 22% of the total amount of chromium is partitioned into the gamma prime phase of the nickel-base superalloy, in an embodiment. In an embodiment in which aluminum is a primary constituent of the gamma prime phase, about 13% of a total amount of aluminum in the alloy is partitioned into the gamma phase of the nickel-base superalloy and about 87% of the total amount of aluminum is partitioned into the gamma prime phase of the nickel-base superalloy.

In order to achieve maximum creep strength, the gamma prime concentration in the superalloy is preferably in the range of from about 57 to about 73 volume percent after heat treatment. This criterion may be achieved by maintaining the amount of Al, Cr, and large radius elements that partition into the gamma prime phase in the range from about 16.0 to 18.0 atomic percent.

To minimize the occurrence of casting defects, such as stray grains or freckles, in the single crystal superalloy, particular constituents of may be present in the nickel-base superalloy at certain ratios relative to each other. For example, weight percent of the group of tantalum and hafnium present in the nickel-base superalloy may be divided by the weight percent of the group of rhenium, tungsten, and ruthenium present in the nickel-base superalloy at a ratio of less than about 0.8%, by weight. In other embodiments, the ratio between the concentrations of tantalum/hafnium and rhenium/tungsten/ruthenium may be greater than the aforementioned range.

To optimize the nickel-base single crystal alloys for turbine blade applications, the selection of large radius elements for improving creep strength may be biased in favor of those large radius elements with lower density. Consequently, some alloys may have little or no tungsten as an alloying element. Minimizing tungsten in favor of lower density elements may enable the creation of very high rupture-life superalloys with a density of about 9.0 grams per centimeter$^3$ or less. Optimal strength and density of the nickel-base superalloy depends on the total concentrations of atoms present in the gamma phase and the gamma prime phase. For example, in an embodiment a concentration of the large radius elements disposed in the gamma phase of the nickel-base superalloy is in a range of from about 4.4 to about 6.7, by atomic percent and a concentration of the large radius elements disposed in the gamma prime phase of the nickel-base superalloy is in a range of from about 4.2 to about 7.0, by atomic percent, the density of the nickel-base superalloy may be about 9.0 grams per centimeter$^3$ or less. In another embodiment in which the large radius elements is disposed in the gamma phase of the nickel-base superalloy is in a range of from about 3.6 to about 4.4, by atomic percent and the large radius elements is disposed in the gamma prime phase of the nickel-base superalloy is in a range of from about 4.2 to about 7.0, by atomic percent, the density of the nickel-base superalloy may be further reduced to about 8.9 grams per centimeter$^3$ or less. By tailoring the composition of the nickel-base superalloy such that the density is relatively low, lower weight components may be produced, which may be preferred in some embodiments. For example, lower density blades may reduce the stress on a turbine disk and hence may enable longer life and lighter weight turbines.

A non-exhaustive listing of some single crystal nickel-base superalloys according to various embodiments that meet the above criteria is provided below in Table 1.

TABLE I

Compositions (atomic %) and densities of some example alloys

| Alloy | Cr | Co | Mo | W | Ta | Re | Ru | Nb | Al | Ti | Hf | Y | Ni | density, g/cm$^3$ |
|---|---|---|---|---|---|---|---|---|---|---|---|---|---|---|
| AG | 1.5 | 10 | 3.5 | 0 | 2 | 1.2 | 0 | 1.2 | 12.6 | 0.9 | 0.03 | 0 | Balance | 8.67 |
| AD | 1.5 | 10 | 4.5 | 0 | 1.2 | 1.2 | 0 | 1.5 | 13.6 | 0.07 | 0.03 | 0 | Balance | 8.57 |
| Y | 5 | 10 | 4 | 0 | 1.5 | 1.5 | 0 | 0.1 | 11.4 | 2.8 | 0.03 | 0 | Balance | 8.59 |
| E | 2.5 | 10 | 4.5 | 0 | 3 | 1.7 | 0 | 0 | 13 | 0.1 | 0.03 | 0 | Balance | 8.84 |
| L | 2.3 | 10 | 5 | 0 | 3.2 | 1.6 | 0 | 0 | 12.5 | 0.1 | 0.03 | 0 | Balance | 8.9 |
| AK | 5 | 10 | 5 | 0 | 3.2 | 1.6 | 1.5 | 0 | 12.4 | 0.1 | 0.03 | 0 | Balance | 8.91 |
| AM | 5 | 10 | 6 | 0 | 3.2 | 1.6 | 1.7 | 0 | 11.8 | 0.1 | 0.03 | 0 | Balance | 8.98 |
| U | 5 | 10 | 5 | 0 | 3.2 | 1.6 | 0 | 0 | 12.4 | 0.1 | 0.03 | 0 | Balance | 8.85 |
| AH | 1.5 | 10 | 6.5 | 0 | 1.2 | 1.3 | 0 | 2.2 | 12.5 | 0.07 | 0.03 | 0 | Balance | 8.7 |
| AC | 1.5 | 10 | 6.5 | 0 | 1.2 | 1.3 | 0 | 1 | 13.6 | 0.07 | 0.03 | 0 | Balance | 8.62 |
| AI | 1.5 | 10 | 7.5 | 0 | 1.2 | 1.3 | 0 | 1 | 13.3 | 0.07 | 0.03 | 0 | Balance | 8.66 |
| AN | 1.5 | 10 | 7.5 | 0 | 1.4 | 1.5 | 0 | 1 | 13.2 | 0.07 | 0.03 | 0 | Balance | 8.72 |

TABLE 2

Densities and large radius element partitioning of some nickel-base single crystal superalloys according to various embodiments.

| Alloy | density, g/cm$^3$ | Large radius elements in γ', at % | Large radius elements in γ, at % |
|---|---|---|---|
| AG | 8.67 | 5.1 | 3.73 |
| AD | 8.57 | 4.24 | 4.26 |
| Y | 8.59 | 5.59 | 4.34 |
| E | 8.84 | 4.62 | 4.71 |
| L | 8.9 | 4.95 | 4.98 |
| AK | 8.91 | 5.76 | 5.67 |
| AM | 8.98 | 6.21 | 6.42 |
| U | 8.85 | 4.95 | 4.98 |
| AH | 8.7 | 5.57 | 5.73 |
| AC | 8.62 | 4.49 | 5.61 |
| AI | 8.66 | 4.83 | 6.27 |
| AN | 8.72 | 5.04 | 6.46 |

Nickel-base superalloys have been provided that are improved over conventional nickel-base superalloys. The nickel-base superalloys described above may have increased stress rupture lives, as compared to conventional nickel-base superalloys. For example, the nickel-base superalloys described above may have rupture lives in a range of 150 to 1350 hours, when exposed to a temperature of about 1100° C. and a stress of about 137 megaPascals. Additionally, by employing a greater amount of large radius elements that are lighter in atomic weight than those elements that are heavier in atomic weight, the density of the nickel-base superalloy may be less than that of conventional nickel-base superalloys as illustrated in Table 2.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A nickel-base superalloy having a gamma phase and a gamma prime phase, the nickel-base superalloy comprising:

nickel at a concentration in a range of from about 60.0 to about 70.0 atomic percent;

cobalt at a concentration of about 10 atomic percent;

aluminum in a range of about 10 to about 14 atomic percent of which about 13% of a total amount of aluminum is partitioned into the gamma phase of the nickel-base superalloy and about 87% of the total amount of aluminum is partitioned into the gamma prime phase of the nickel-base superalloy;

chromium at a concentration in a range of about 0.5 to about 6.0, by atomic percent, of which about 78% of a total amount of chromium is partitioned into the gamma phase of the nickel-base superalloy and about 22% of the total amount of chromium is partitioned into the gamma prime phase of the nickel-base superalloy; and large radius elements comprising molybdenum, rhenium, tantalum, and titanium, and optionally comprising one or more of hafnium, niobium, and precious metal elements, the precious metal elements selected from the group consisting of ruthenium, platinum, iridium and rhodium, and combinations thereof;

wherein:

a concentration of the large radius elements is disposed in the gamma phase of the nickel-base superalloy being in a range of from about 4.4 to about 6.7, by atomic percent, a concentration of the large radius elements is disposed in the gamma prime phase of the nickel-base superalloy being in a range of from about 4.2 to about 7.0, by atomic percent, molybdenum at a concentration in a range of from about 3.0 to about 10.0 atomic percent of which about 66% of a total amount of molybdenum is partitioned into the gamma phase of the nickel-base superalloy and about 34% of the total amount of molybdenum is partitioned into the gamma prime phase of the nickel-base superalloy, rhenium at a concentration in a range of from about 0.8 to about 2.4 atomic percent of which about 84% of a total amount of rhenium is partitioned into the gamma phase of the nickel-base superalloy and about 16% of the total amount of rhenium is partitioned into the gamma prime phase of the nickel-base superalloy, tantalum at a concentration in a range from about 1.0 to about 4.0 atomic percent of which about 10% of a total amount of tantalum is partitioned into the gamma phase of the nickel-base superalloy and about 90% of the total amount of tantalum is partitioned into the gamma prime phase of the nickel-base superalloy, titanium at a concentration in a range from about 0.05 to about 3.0 atomic percent of which about 10% of a total amount of titanium is partitioned into the gamma phase of the nickel-base superalloy and about 90% of the total amount of titanium is partitioned into the gamma prime phase of the nickel-base superalloy, hafnium at a concentration in a range from about 0 to about 0.1 atomic percent and if present about 10% of a total amount of hafnium is partitioned into the gamma phase of the nickel-base superalloy and about 90% of the total amount of hafnium is partitioned into the gamma prime phase of the nickel-base superalloy, niobium at a concentration in a range from about 0 to about 3.0 atomic percent and if present about 10% of a total amount of niobium is partitioned into the gamma phase of the nickel-base superalloy and about 90% of the total amount of niobium is partitioned into the gamma prime phase of the nickel-base superalloy, precious metal elements ruthenium, platinum, iridium, and rhodium, and combinations thereof, wherein the summed precious metal elements are at a concentration from about 0 to about 3.0 atomic percent and if present, about 46% of a total amount of the precious metal elements is partitioned into the gamma phase of the nickel-base superalloy and about 54% of the total amount of the precious metal elements is partitioned into the gamma prime phase of the nickel-base superalloy, and the nickel-base superalloy has a density of about 9.0 grams per centimeter$^3$ or less.

2. The nickel-base superalloy of claim 1, further comprising the large element tungsten wherein:

tungsten is at a concentration in a range of up to about 0.5by atomic percent and about 37% of a total amount of tungsten is partitioned into the gamma phase of the nickel-base superalloy and about 63% of the total amount of tungsten is partitioned into the gamma prime phase of the nickel-base superalloy.

3. The nickel-base superalloy of claim 1, further comprising one or more elements selected from the group consisting of:

carbon at a concentration in range of up to about 0.25, by atomic percent;

silicon at a concentration in range of up to about 0.25, by atomic percent; and boron at a concentration in range of up to about 0.05, by atomic percent.

4. The nickel-base superalloy of claim 1, further comprising one or more elements selected from a group consisting of scandium, yttrium, and an element in the lanthanide series at a concentration in a range of up to about 0.1, by atomic percent.

5. The nickel-base superalloy of claim 1, wherein:

the concentration of the large radius elements plus chromium plus aluminum disposed in the gamma prime phase of the nickel-base superalloy is in a range of from about 16.0 to about 18.0, by atomic percent.

6. A nickel-base superalloy having a gamma phase and a gamma prime phase, the nickel-base superalloy comprising:

nickel at a concentration in a range of from about 60.0 to about 70.0 atomic percent;

cobalt at a concentration of about 10 atomic percent;

aluminum in a range of about 10 to about 14 atomic percent of which about 13% of a total amount of aluminum is partitioned into the gamma phase of the nickel-base superalloy and about 87% of the total amount of aluminum is partitioned into the gamma prime phase of the nickel-base superalloy;

chromium at a concentration in a range of about 0.5 to about 6.0 by atomic percent of which about 78% of a total amount of chromium is partitioned into the gamma phase of the nickel-base superalloy and about 22% of the total amount of chromium is partitioned into the gamma prime phase of the nickel-base superalloy;

and large radius elements comprising molybdenum, rhenium, tantalum, titanium, and optionally comprising one or more of hafnium, niobium, and precious metal elements selected from the group consisting of ruthenium, platinum, iridium and rhodium, and combinations thereof:

wherein:

a concentration of the large radius elements is disposed in the gamma phase of the nickel-base superalloy being in a range of from about 3.6 to about 4.4, by atomic percent, a concentration of the large radius elements is disposed in the gamma prime phase of the nickel-base superalloy being in a range of from about 4.2 to about 7.0, by atomic percent, molybdenum at a concentration in a range of from about 3.0 to about 10.0 atomic percent of which about 66% of a total amount of molybdenum is partitioned into the gamma phase of the nickel-base superalloy and about 34% of the total amount of molybdenum is partitioned into the gamma prime phase of the nickel-base superalloy, rhenium at a concentration in a range of from about 0.8 to about 2.4 atomic percent of which about 84% of a total amount of rhenium is partitioned into the gamma phase of the nickel-base superalloy and about 16% of the total amount of rhenium is partitioned into the gamma prime phase of the nickel-base superalloy, tantalum at a concentration in a range from about 1.0 to about 4.0 atomic percent of which about 10% of a total amount of tantalum is partitioned into the gamma phase of the nickel-base superalloy and about 90% of the total amount of tantalum is partitioned into the gamma prime phase of the nickel-base superalloy, titanium at a concentration in a range from about 0.05 to about 3.0 atomic percent of which about 10% of a total amount of titanium is partitioned into the gamma phase of the nickel-base superalloy and about 90% of the total amount of titanium is partitioned into the gamma prime phase of the nickel-base superalloy, hafnium at a concentration in a range from about 0 to about 0.1 atomic percent and if present, about 10% of a total amount of hafnium is partitioned into the gamma phase of the nickel-base superalloy and about 90% of the total amount of hafnium is partitioned into the gamma prime phase of the nickel-base superalloy, niobium at a concentration in a range from about 0 to about 3.0 atomic percent and if present, about 10% of a total amount of niobium is partitioned into the gamma phase of the nickel-base superalloy and about 90% of the total amount of niobium is partitioned into the gamma prime phase of the nickel-base superalloy, precious metal elements ruthenium, platinum, iridium, and rhodium, and combinations thereof, wherein the summed precious metal elements are at a concentration of about 0 to about 3.0 atomic percent and, if present, about 46% of a total amount of the precious metal elements is partitioned into the gamma phase of the nickel-base superalloy and about 54% of the total amount of the precious metal elements is partitioned into the gamma prime phase of the nickel-base superalloy, and the nickel-base superalloy has a density of about 8.9 grams per centimeter$^3$ or less.

7. The nickel-base superalloy of claim 6, further comprising the large radius element tungsten and wherein:

about 37% of a total amount of tungsten is partitioned into the gamma phase of the nickel-base superalloy and about 63% of the total amount of tungsten is partitioned into the gamma prime phase of the nickel-base superalloy.

8. The nickel-base superalloy of claim 6, further comprising one or more elements selected from the group consisting of:

carbon at a concentration in range of up to about 0.25, by atomic percent;

silicon at a concentration in range of up to about 0.25, by atomic percent; and boron at a concentration in range of up to about 0.05, by atomic percent.

9. The nickel-base superalloy of claim 6, further comprising one or more elements selected from a group consisting of scandium, yttrium, and an element in the lanthanide series at a concentration in a range of up to about 0.1, by atomic percent.

10. The nickel-base superalloy of claim 6, wherein:

the concentration of the large radius elements plus chromium plus aluminum disposed in the gamma prime phase of the nickel-base superalloy is in a range of from about 16.0 to about 18.0, by atomic percent.

11. A nickel-base superalloy having a gamma phase and a gamma prime phase, the nickel-base superalloy comprising about 1.5 to about 5 atomic percent chromium, about 10 atomic percent cobalt, about 11.8 to about 13.6 atomic percent aluminum, about 4.5 to about 7.5 atomic percent molybdenum, about 1.3 to about 1.7 atomic percent rhenium, about 0 to 1.7 atomic % Ru, about 1.2 to about 3.2 atomic percent tantalum, about 0 to 2.2 atomic percent niobium, about 0.03atomic percent hafnium, about 0.1 atomic percent titanium, and the balance nickel.

12. A nickel-base superalloy having a gamma phase and a gamma prime phase, the nickel-base superalloy comprising about 1.5 to about 5 atomic percent chromium, about 10 atomic percent cobalt, about 11.4 to about 13.6 atomic percent aluminum, about 3.5 to about 4.5 atomic percent molybdenum, about 1.2 to about 1.5 atomic percent rhenium, about 1.2 to about 2.0 atomic percent tantalum, about 0.1 to 1.5 atomic percent niobium, about 0.03 atomic percent hathium, about 0.07 to about 2.8atomic percent titanium, and the balance nickel.

* * * * *